US007517176B2

(12) United States Patent
Henderson

(10) Patent No.: US 7,517,176 B2
(45) Date of Patent: Apr. 14, 2009

(54) MASONRY BLOCK

(76) Inventor: Rodney Henderson, 97 Abernethy Road, Belmont, Western Australia (AU) 6104

( * ) Notice: Subject to any disclaimer, the term of this patent is extended or adjusted under 35 U.S.C. 154(b) by 33 days.

(21) Appl. No.: 11/814,924

(22) PCT Filed: Apr. 13, 2006

(86) PCT No.: PCT/AU2006/000501

§ 371 (c)(1),
(2), (4) Date: Jul. 27, 2007

(87) PCT Pub. No.: WO2006/110943

PCT Pub. Date: Oct. 26, 2006

(65) Prior Publication Data

US 2008/0134603 A1 Jun. 12, 2008

(30) Foreign Application Priority Data

Apr. 18, 2005 (AU) ..... 2005901902
Jun. 22, 2005 (AU) ..... 2005903270

(51) Int. Cl.
*E02D 29/02* (2006.01)

(52) U.S. Cl. ..... 405/262; 405/284; 405/286

(58) Field of Classification Search ..... 405/262, 405/284, 286
See application file for complete search history.

(56) References Cited

U.S. PATENT DOCUMENTS

| | | | | |
|---|---|---|---|---|
| 4,884,921 | A | 12/1989 | Smith | |
| 4,920,712 | A * | 5/1990 | Dean, Jr. | 405/286 |
| 5,066,169 | A | 11/1991 | Gavin et al. | |
| 5,975,809 | A * | 11/1999 | Taylor et al. | 405/262 |
| 6,287,054 | B1 * | 9/2001 | Egan et al. | 405/262 |
| 2003/0213203 | A1 * | 11/2003 | Bott et al. | 405/262 |

FOREIGN PATENT DOCUMENTS

| | | | |
|---|---|---|---|
| JP | 2003003474 | A | 1/2003 |
| JP | 2003166244 | A | 6/2003 |
| JP | 2003321839 | A | 11/2003 |
| JP | 2004060220 | A | 2/2004 |

* cited by examiner

*Primary Examiner*—Frederick L Lagman
(74) *Attorney, Agent, or Firm*—David A. Guerra

(57) ABSTRACT

A masonry block (10) has a rearwardly extending portion (18) which includes a vertical channel (24). In use, soil stabilizing members (46) are passed through channels of aligned masonry blocks (10) and extended rearwardly behind a retaining wall (40).

14 Claims, 3 Drawing Sheets

MASONRY BLOCK

CROSS-REFERENCE TO RELATED APPLICATIONS

This application is an U.S. national phase application under 35 U.S.C. §371 based upon co-pending International Application No. PCT/AU2006/000501 filed on Apr. 13, 2006. Additionally, this U.S. national phase application claims the benefit of priority of co-pending International Application No. PCT/AU2006/000501 filed on Apr. 13, 2006, Australia Application No. 2005901902 filed on Apr. 18, 2006 and Australia Application No. 2005903270 filed on Jun. 22, 2005. The entire disclosures of the prior applications are incorporated herein by reference. The international application was published on Oct. 26, 2006 under Publication No. WO2006/110943.

FIELD OF THE INVENTION

The present invention relates to a masonry block for use in a retaining wall, and a method of construction of a retaining wall including the provision of soil stabilising members.

BACKGROUND TO THE INVENTION

It is known to require the use of soil stabilising members in conjunction with retaining walls. Typical soil stabilising members comprise sheets of mesh-like material known as "geogrid". The sheets are affixed between courses of masonry blocks used in the retaining wall construction, and extend behind the retaining wall to reinforce and stabilise the soil being retained.

There are several known methods for affixing the sheets between masonry block courses. Typically, these use pins or similar devices passed through the blocks and the sheet to restrain movement of the sheet relative to the blocks.

This process can be time consuming. Additionally, it must be done during the building of the wall, with the sheets being placed between appropriate courses whilst the wall is be constructed. This greatly reduces the efficiency of labour during construction of the retaining wall.

An alternative method which has been proposed is to use hollow blocks having a vertically aligned inner cavity, and to pass strips of soil stabilising material through the cavities of adjacent blocks. The strips can then be passed out between courses as required.

This method shares many of the disadvantages of the use of sheets described above. It requires the strips to be fed through the blocks during construction of the wall, and greatly adds to the complexity and time of the wall building process.

The present invention attempts to overcome at least in part some of the aforementioned disadvantages of previous masonry blocks and methods of affixing soil stabilising members thereto.

SUMMARY OF THE INVENTION

In accordance with one aspect of the present invention there is provided a masonry block having a front face and a rear face, characterised in that the rear face includes a back wall and an extension portion extending outwardly therefrom, the extension portion including a channel passing therethrough, the channel having openings at either end thereof, wherein, in use, when the extension portion of a first block in a first course is located adjacent the back wall of at least one adjacent second block in an adjacent second course, the front faces of the first and second blocks being substantially co-planar, a channel opening of the first block locates adjacent to, and outside of, the back wall of the second block, and whereby a portion of a soil restraining member may be restrained within the channel.

In accordance with a second aspect of the present invention there is provided a method of construction of a retaining wall, the method characterised by including the steps of laying courses of masonry blocks to form a wall having a rear face, at least one of the masonry blocks having an extension portion which extends beyond the rear face, the extension portion having a channel passing therethrough; passing a portion of a soil stabilising member through the channel to be retained thereby; moving an outer portion of the soil stabilising member away from the rear face; and filling against the rear wall face with filling material to cover the outer portion of the soil stabilising member.

BRIEF DESCRIPTION OF THE DRAWINGS

The present invention will now be described, by way of example, with reference to the accompanying drawings, in which.

DESCRIPTION OF PREFERRED EMBODIMENTS

Figure 1:
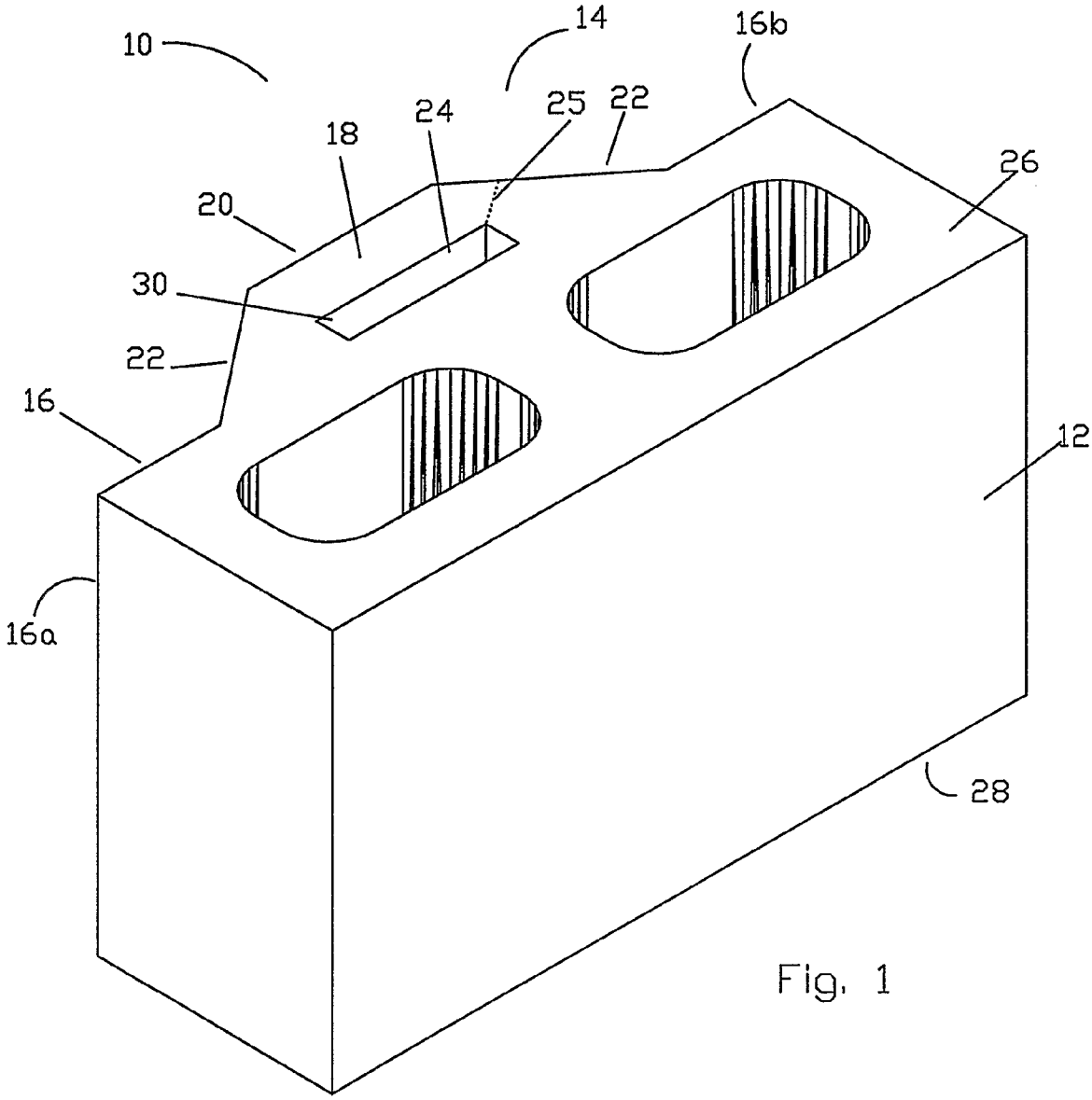
FIG. 1 is an isometric view of a masonry block in accordance with the present invention.

Referring to the Figures, there is shown a masonry block 10 having a substantially planar front face 12 and a rear face 14.

The rear face 14 has a back wall 16 substantially parallel to the front face 12, and an extension portion 18 extending outwardly from the back wall 16. The extension portion 18 in the embodiment of the drawings is trapezoid in shape, with an outermost face 20 which is substantially parallel to the front face 12, and two angled side faces 22 which taper from the back wall 16. The back wall 16 is thus divided into two substantially equal portions 16*a* and 16*b*, each of which are about two-thirds the width of the outermost face 10.

A substantially rectangular channel 24 passes through the extension portion 18 from a top face 26 of the block 10 to a bottom face 28. The channel 24 is substantially parallel to, and of approximately equal length to, the outermost face 20. The channel 24 is entirely contained within the extension portion 18, and is thus outside a plane determined by the back wall 16. The channel 24 has an openings at either end, with an upper opening 30 at the top face 26 and a lower opening (not shown) at the bottom face 28.

The portion of the block between the side walls 22 and the channel 24 is a shear-supporting portion 25.

Figure 2:
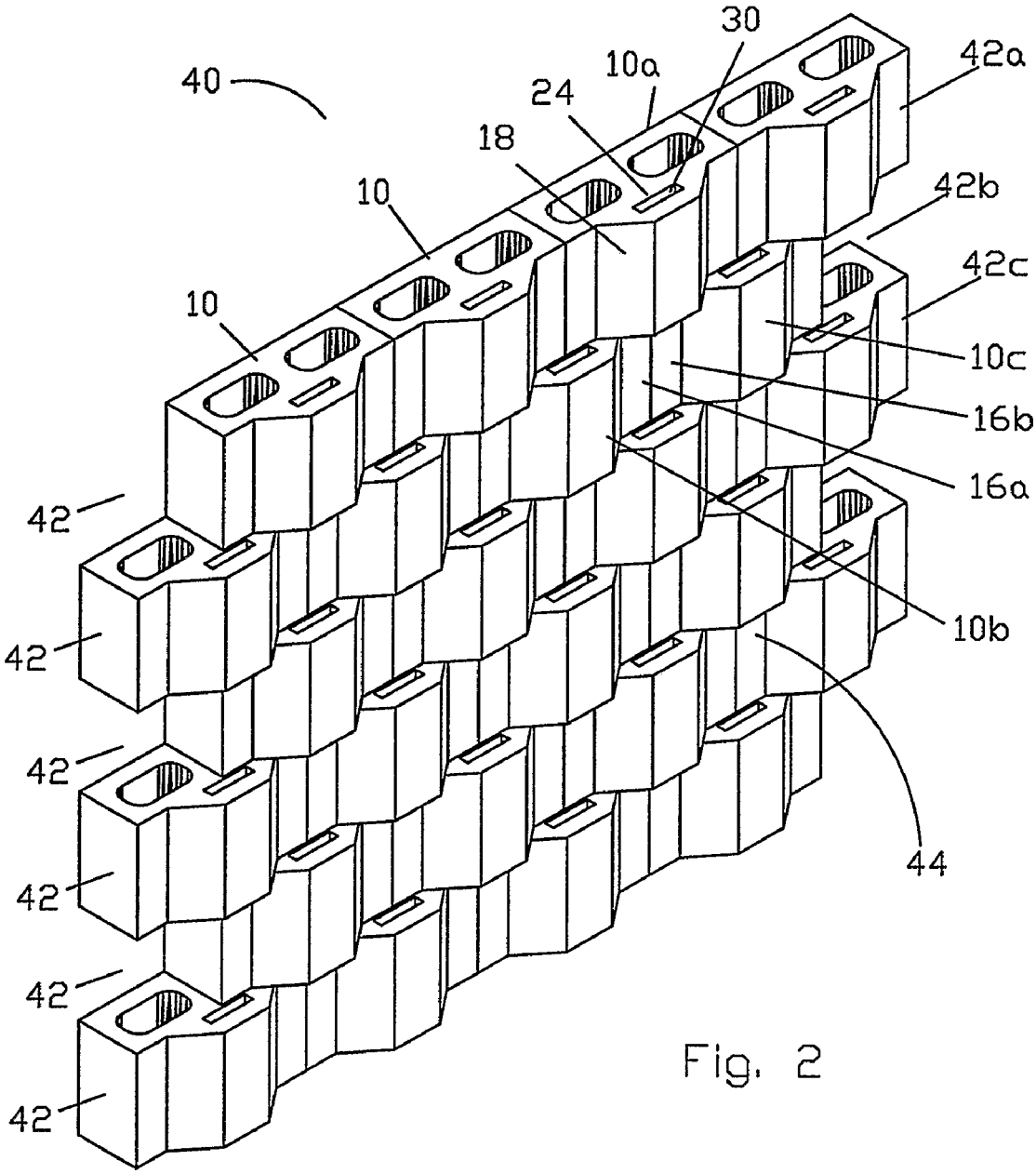
FIG. 2 is a rear isometric view retaining wall constructed of masonry blocks as shown in FIG. 1.

In use, a retaining wall 40 as shown in FIG. 2 is constructed from a plurality of masonry blocks 10. The wall is constructed by laying the masonry blocks 10 in a plurality of courses 42. The blocks are layed such that the front faces 12 of the blocks 10 are substantially co-planar, as are the back walls 16. The back walls 16 combine to form a rear face 44 of the retaining wall 40.

Each course 42 is offset from an adjacent course 42 by 50%. In this way the extension portion 18 of a first block 10*a* in a first course 42*a* is adjacent a portion 16*a* of the back wall 16 of an adjacent second block 10*b*, and adjacent a portion

16*b* of the back wall 16 of an adjacent third block 10*c*, the second and third blocks 10*b*, 10*c* being in a second course 42*b*.

It will thus be apparent that the lower opening of the channel 24 of the first block 10*a* locates outside the back wall 16 of the adjacent blocks 10*b*, 10*c*, and is thus accessible even after subsequent courses 42 have been laid.

Once the retaining wall has been constructed as shown in FIG. 2, it is possible to introduce soil reinforcing members in the forms of strips 46 of geo-grid material into the retaining wall. In a preferred deployment of such strips, an inner portion 48 of a strip 46 is passed through the channels 24 of two parallel blocks 10*a*, 10*d*, the parallel blocks being in first and third courses 42*a*, 42*c* separated by a second course 42*b*. The strip 46 has two outer portions 50 extending from the upper opening 30 of the first block 10*a* and the lower opening of the fourth block 10*d*.

Figure 3:
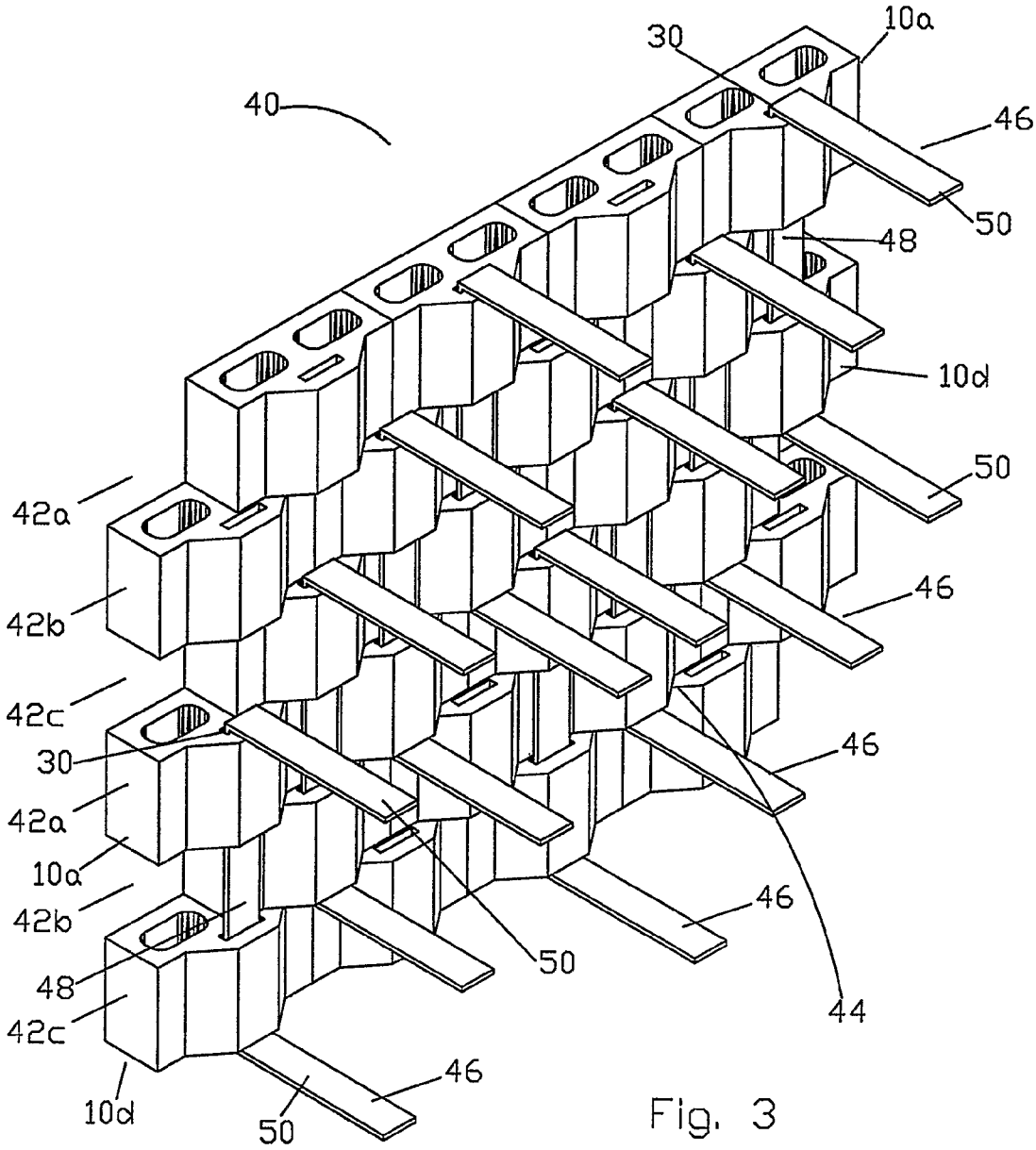
FIG. 3 is a rear isometric view of the retaining wall of FIG. 2 including a plurality of soil stabilising members located therewithin.

Preferably, strips 46 of geo-grid material are arrayed through the retaining wall 40 as shown in FIG. 3.

In an alternative deployment, strips 46 can be passed through a single block 10.

The outer portions 50 of the strips 46 are moved away from the rear face 44 of the retaining wall 40 as shown in FIG. 3. The rear face 44 can then be filled against with filling material such as soil, the strips 46 acting to both stabilise the soil and strengthen the wall.

It will be appreciated that the shear supporting portion 25 of the blocks 10 must be sufficiently strong to withstand shear forces introduced through the strips 46 when the retaining wall 40 is in use. It will also be appreciated that the channel is sized so as to allow the strip to pass within without restriction. In particular, the width of the channel is larger than that of the reinforcing member.

Modifications and variations as would be apparent to a skilled addressee are deemed to be within the scope of the present invention.

The invention claimed is:

1. A masonry block comprising:

a front face; and a rear face, wherein the rear face includes a back wall and an extension portion extending outwardly therefrom, the extension portion including a channel passing therethrough, the channel having openings at either end thereof, wherein, in use, when the extension portion of a first block in a first course is located adjacent the back wall of at least one adjacent second block in an adjacent second course, the front faces of the first and second blocks being substantially co-planar, a channel opening of the first block locates adjacent to, and outside of, the back wall of the second block, and whereby a portion of a soil restraining member may be restrained within the channel;

wherein the channel being defined through the extension portion from a top face of the masonry block to a bottom face of the masonry block.

2. The masonry block as claimed in claim 1, wherein the channel is substantially parallel to the front face.

3. The masonry block as claimed in claim 2, wherein the extension portion is located substantially centrally of the rear face.

4. The masonry block as claimed in claim 3, wherein the extension portion has an outermost face substantially parallel to the front face.

5. The masonry block as claimed in claim 4, wherein the extension portion divides the rear wall into two portions, each of which are about two thirds the width of the outermost face.

6. The masonry block as claimed in claim 5, wherein the channel is substantially rectangular.

7. The masonry block as claimed in claim 1, wherein the extension portion having a substantially trapezoidal configuration with an outermost face which is substantially parallel to the front face.

8. The masonry block as claimed in claim 1, wherein the extension portion further comprising two angled side faces which taper from the back wall to an outermost face of the extension portion.

9. The masonry block as claimed in claim 1, wherein the channel being substantially parallel to, and of substantially equal length to, an outermost face of the extension portion.

10. A method of construction of a retaining wall, the method comprising the steps of:

providing at least one masonry block comprising: a front face; and a rear face, wherein the rear face includes a back wall and an extension portion extending outwardly therefrom, the extension portion including a channel passing therethrough, the channel having openings at either end thereof; wherein the channel being defined through the extension portion from a top face of the masonry block to a bottom face of the masonry block;

laying courses of masonry blocks to form a wall having a rear face, at least one of the masonry blocks having an extension portion which extends beyond the rear face, the extension portion having a channel passing therethrough wherein each course is offset from an adjacent course by about 50% so that lower openings of the channels of the masonry blocks of a first course are located outside the back wall of adjacent masonry blocks of a second course offset from the first course;

passing a portion of a soil stabilizing member through the channel of at least one masonry block to be retained thereby;

moving an outer portion of the soil stabilizing member away from the rear face; and filling against the rear wall face with filling material to cover the outer portion of the soil stabilizing member.

11. The method of construction of a retaining wall as claimed in claim 10, wherein the soil stabilizing member has upper and lower outer portions which are moved away from the rear face.

12. The method of construction of a retaining wall as claimed in claim 11, wherein the soil stabilizing member is passed through the channel of at least two masonry blocks.

13. The method of construction of a retaining wall as claimed in claim 12, wherein the two masonry blocks are in two courses, the two courses being separated by at least one course.

14. A masonry block system comprising:

a substantially planar front face;

a rear face having a back wall substantially parallel to the front face;

an extension portion extending outwardly from the back wall, the extension portion having a substantially trapezoidal configuration with an outermost face which is substantially parallel to the front face, and two angled side faces which taper from the back wall; and a substantially rectangular channel defined through the extension portion from a top face of the masonry block system to a bottom face, the channel being substantially parallel to, and of substantially equal length to, the outermost face, the channel being contained within the extension portion and outside a plane determined by the back wall, the channel further comprising an upper opening at the top face and a lower opening at the bottom face, the channel being adapted to receive a portion of a soil restraining member therethrough;

wherein the back wall being divided into two substantially equal portions by the extension portion, each portion being about two-thirds the width of the outermost face;

wherein a portion of the masonry block system between each of the two angled side faces and the channel is a shear-supporting portion.

* * * * *